US007795554B2

(12) United States Patent
Kim

(10) Patent No.: US 7,795,554 B2
(45) Date of Patent: Sep. 14, 2010

(54) ANTISTATIC COMPONENT AND METHOD OF MANUFACTURING THE SAME

(75) Inventor: Jae Moon Kim, Hwaseong (KR)

(73) Assignee: LG Electronics Inc., Seoul (KR)

( * ) Notice: Subject to any disclaimer, the term of this patent is extended or adjusted under 35 U.S.C. 154(b) by 211 days.

(21) Appl. No.: 11/592,958

(22) Filed: Nov. 6, 2006

(65) Prior Publication Data

US 2007/0289857 A1 Dec. 20, 2007

(30) Foreign Application Priority Data

Jun. 14, 2006 (FR) ..... 10-2006-0053609

(51) Int. Cl.
*H01H 13/00* (2006.01)

(52) U.S. Cl. ..... 200/552; 200/343

(58) Field of Classification Search ..... 200/345, 200/343, 552

See application file for complete search history.

(56) References Cited

U.S. PATENT DOCUMENTS 6,355,890 B1 * 3/2002 Kuroda ..... 200/5 A
6,835,906 B2 * 12/2004 Okamoto et al. ..... 200/341

* cited by examiner

*Primary Examiner*—Renee S Luebke
*Assistant Examiner*—Sean Kayes
(74) *Attorney, Agent, or Firm*—Birch, Stewart, Kolasch & Birch, LLP

(57) ABSTRACT

The present invention relates to an antistatic component and a method of manufacturing the same. An antistatic component of the present invention comprises buttons each of which includes a push portion 11 or 11' formed at one end of the button and made of a first resin and a switch contact 13 or 13' formed at the other end of the button and made of a second resin; and an elastically-deformable connection portion 15 formed integrally with the switch contact 13 or 13' so as to connect the plurality of buttons to one another. The push portion is exposed outward to be pushed and has a plating layer 12 or 12' formed thereon, and the switch contact selectively operates a tact switch 4 or 4'. The first resin comprises a plating material and the second resin comprises a non-plating material. The switch contact and the connection portion, and the push portion are formed integrally with each other by means of dual injection molding. With the antistatic component and the method of manufacturing the same according to the present invention constructed as above, penetration of static electricity is prevented while the durability and appearance of the button are maintained. Thus, there are advantages in that the appearance of a part can be sufficiently decorated, an internal system can be effectively protected, and a process of manufacturing a part can be simplified, resulting in improved productivity.

1 Claim, 4 Drawing Sheets

ANTISTATIC COMPONENT AND METHOD OF MANUFACTURING THE SAME

BACKGROUND OF THE INVENTION

1. Field of the Invention

The present invention relates to an antistatic component and a method of manufacturing the same, and more particularly, to an antistatic component for preventing introduction of static electricity into an internal system and a method of manufacturing the component.

2. Description of the Related Art

Generally, an electronic product includes a system unit in which various parts are mounted to a circuit board to execute operations of the electronic product. A variety of parts are electrically connected to the system unit. Among these parts, some parts are charged with static electricity in certain cases. Typical examples of these parts are a button and a connector. Hereinafter, the related art will be described in connection with a button.

A potable electronic device such as a cellular phone or PDA is provided with a button array for use in selectively manipulating switches provided on a circuit board within a case of the electronic device. If a user of the electronic device pushes a button in the button array, a switch that is brought into contact the button transmits a signal to a system unit, thereby executing a corresponding operation.

This button is plated for better appearance or prevention of breakdown of the button. However, such a plated button exhibits conductivity. Thus, when the user of the electronic device pushes the plated button, an electric charge charged to the human body may be transmitted to the switch through the button, which may cause ESD (Electrostatic Discharge). If static electricity flows into the system unit through the plated button, it may damage parts or disturb the system unit, thereby causing malfunction.

In order to solve this problem, an additional intermediate member made of an insulating material is installed between the plated button and the switch connected to the system unit in the prior art. The intermediate member made of an insulating material prevents the static electricity flowing along the button from penetrating into the system unit. However, there are problems in that the intermediate member made of an insulating material should be separately prepared and a process of installing and fixing the member should be added.

Meanwhile, in another prior art, the button itself is made of an insulating material such as rubber so that it does not exhibit any conductivity. However, in this case, the button surface exposed to the outside may be worn away or easily broken down.

SUMMARY OF THE INVENTION

Accordingly, the present invention is conceived to solve the problems in the prior art. An object of the present invention is to provide an antistatic component for shielding static electricity while keeping the durability and design of a part.

Another object of the present invention is to provide an antistatic component enabling simplification of a process of manufacturing a part.

According to an aspect of the present invention for achieving the objects, there is provided an antistatic component, comprising buttons each of which includes a push portion formed at one end of the button and made of a first resin and a switch contact formed at the other end of the button and made of a second resin; and an elastically-deformable connection portion formed integrally with the switch contact so as to connect the plurality of buttons to one another. The push portion is exposed outward to be pushed and has a plating layer formed thereon, and the switch contact selectively operates a switch.

The connection portion may include at least two elastic bridges; and a fixing frame provided between the elastic bridges and formed with a fixing hole into which a fixing means is inserted for coupling with an electronic product.

The second resin may comprise an insulating material.

The first resin may comprise a plating material that can be plated, and the second resin may comprise an insulating, non-plating material that cannot be plated.

The connection portion may be made of the same material as the switch contact.

The switch contact and the connection portion, and the push portion may be molded by means of dual injection molding.

According to another aspect of the present invention, there is provided an antistatic component, comprising a housing which is formed to surround an outer periphery of a terminal to be connected to an internal system and is primarily injection molded out of a non-plating material that cannot be plated; and a grip which is formed integrally with the housing and is secondarily injection molded out of a plating material that can be plated.

A plating layer may be formed on the grip.

The housing may be made of an insulating, non-plating material.

According to a further aspect of the present invention, there is provided a method of manufacturing an antistatic component integrally having a system-contacting portion and a grip, comprising a first step of molding any one of the system-contacting portion out of a non-plating material and the grip out of a plating material; a second step of molding the other one to be formed integrally with the previously molded body of the first step; and a third step of forming a plating layer on the grip made of the plating material.

With the antistatic component constructed as above and the method of manufacturing the same according to the present invention, penetration of static electricity is prevented while the durability and appearance of a part is maintained. Thus, there are advantages in that an internal system can be effectively protected and productivity can be improved while the appearance of the part is sufficiently decorated.

BRIEF DESCRIPTION OF THE DRAWINGS

The above and other objects, features and advantages of the present invention will become apparent from the following description of preferred embodiments given in conjunction with the accompanying drawings, in which.

DESCRIPTION OF THE PREFERRED EMBODIMENT

Hereinafter, preferred embodiments of an antistatic component and a method of manufacturing the same according to the present invention will be described in detail with reference to the accompanying drawings.

Figure 1:
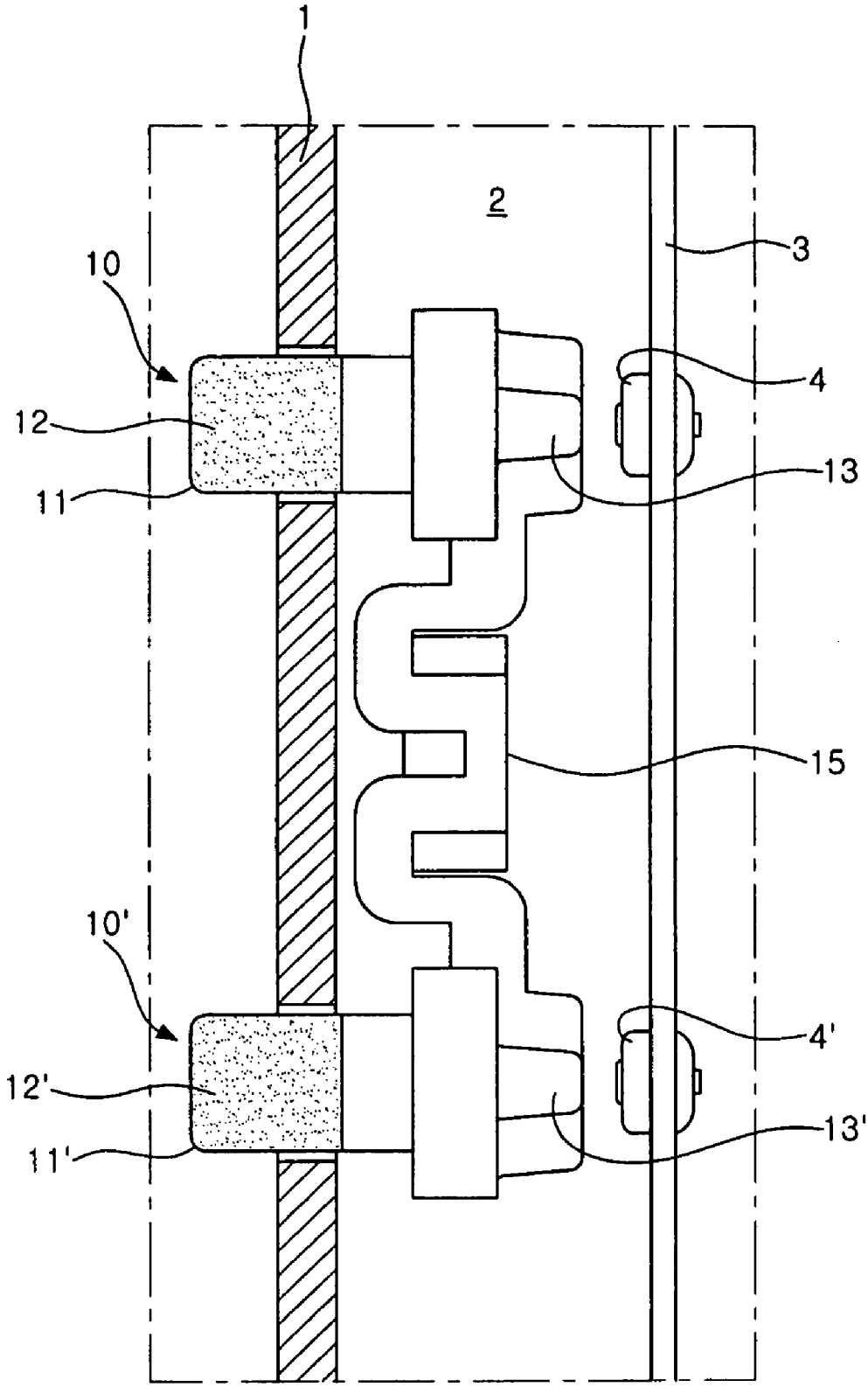
FIG. 1 is a partial sectional view showing a button array and its peripheral configuration according to an embodiment of the present invention.
Figure 2:
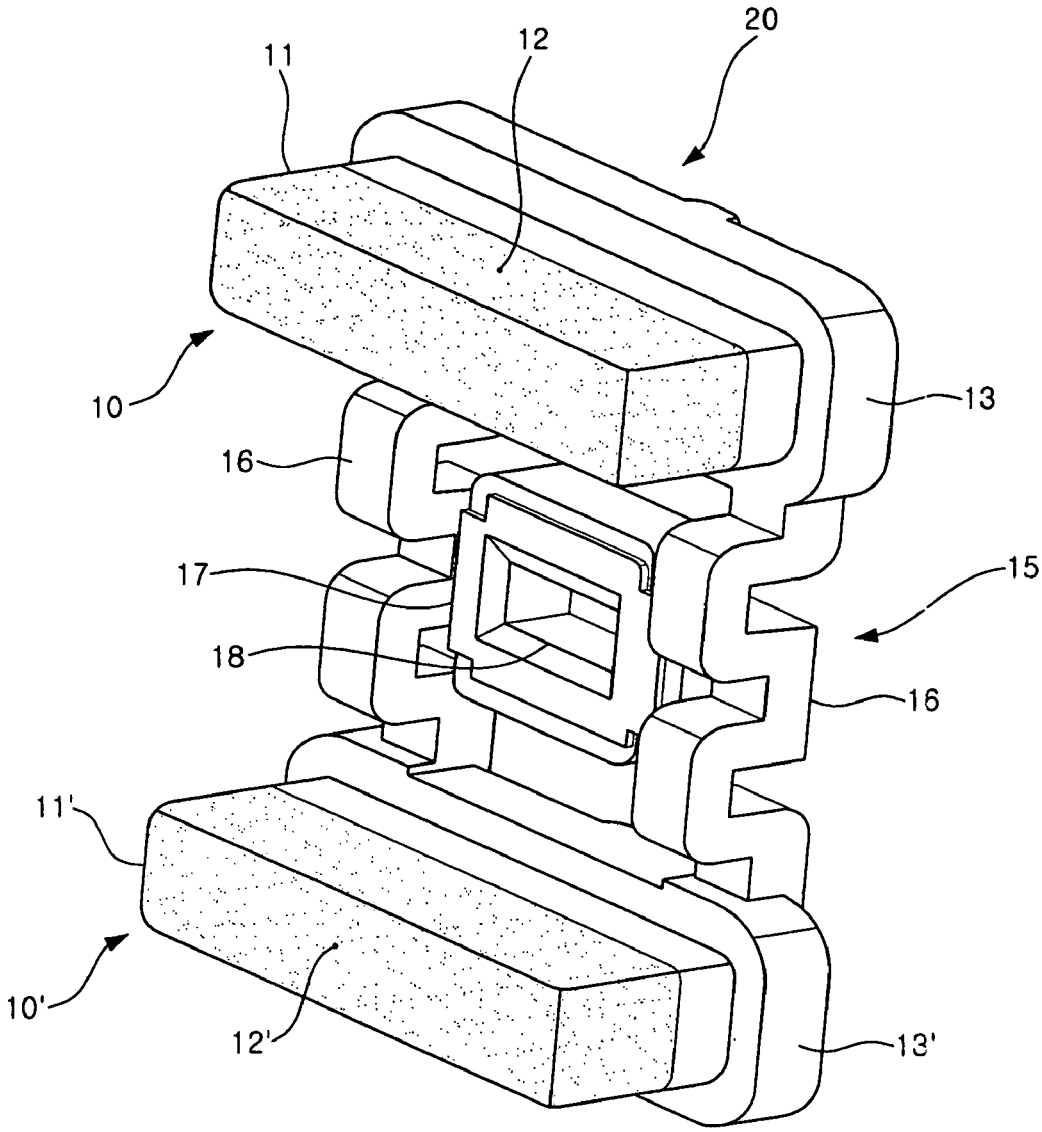
FIG. 2 is a perspective view showing the button array of FIG. 1.
Figure 3:
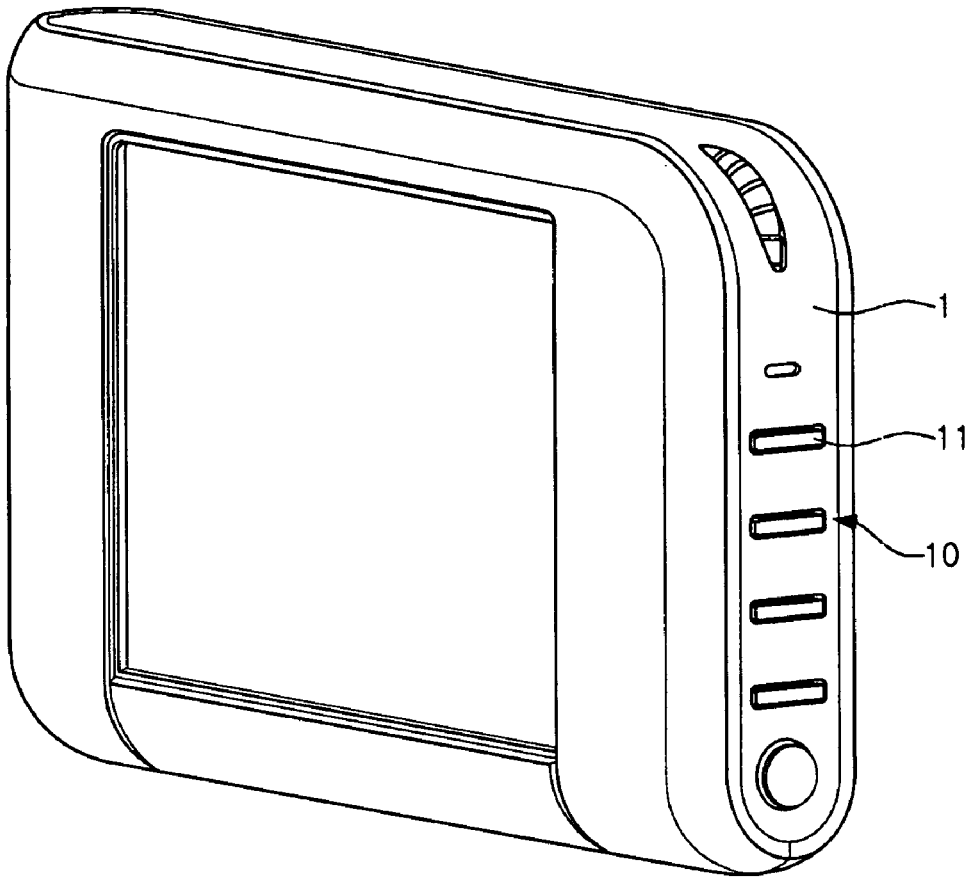
FIG. 3 is a perspective view showing an appearance of an electronic product in which the button array according to the present invention is installed.

FIG. 1 is a partial sectional view showing a button array and its peripheral configuration according to an embodiment of the present invention, FIG. 2 is a perspective view showing the button array of FIG. 1, and FIG. 3 is a perspective view showing an appearance of an electronic product in which the button array of FIG. 2 is installed.

As shown these figures, an electronic product has a case 1 defining an appearance thereof. The case 1 has a certain inner space 2 therein. A board 3 for mounting various parts thereon is provided in the inner space 2. A tack switch 4 for applying a signal to an internal system is provided on the board 3.

A button array 20 is provided in the inner space 2. In this embodiment, the button array generally includes a plurality of buttons 10 and 10', which are composed of push portions 11 and 11' and switch contacts 13 and 13', respectively; and a connection portion 15. Here, the switch contacts 13 and 13' and the connection portion 15 are provided within the electronic product and serve as system-contacting portions that can be brought into contact with the internal system of the electronic product.

One ends of the buttons 10 and 10' are constructed as the push portions 11 and 11' that are exposed out of the case 1. The surfaces of the push portions 11 and 11' are portions with which a finger of a user comes into direct contact. The push portions 11 and 11' have any shape so far as they can be pushed from the outside. In addition, the push portions 11 and 11' may be formed to more protrude beyond the surface of the case 1. As described above, the push portions 11 and 11' may have various shapes depending on an appearance design of an electronic product to which the button array is applied.

In this embodiment, the push portions 11 and 11' are molded out of a plating material, i.e., a material that can be plated. A plastic resin (e.g., ABS) may be generally used as the plating material. In addition, the surfaces of the push portions 11 and 11' are covered with plating layers 12 and 12' through plating. The plating layers decorate the appearance of the button and prevent the button from being worn away due to contact of a user. In addition, since the push portions 11 and 11' are covered with the plating layers 12 and 12', respectively, the plating layers 12 and 12' receive all electrons even though they are charged with static elasticity due to external contact, thereby preventing movement of electrons toward other parts.

Meanwhile, the other ends of the buttons 10 and 10' are constructed as the switch contacts 13 and 13' that are selectively brought into contact with the tack switches 4 and 4' provided on the board 3 within the inner space 2. The switch contacts 13 and 13' are placed in the inner space 2 and function to press the tack switches 4 and 4' by means of pressure transferred through the push portions 11 and 11'.

In this embodiment, the switch contacts 13 and 13' are made of an insulating material. This is to prevent static electricity flowing through the push portions 11 and 11' from penetrating into the tack switches 4 and 4'.

In addition, the switch contacts 13 and 13' are made of a non-plating material. That is, the switch contacts 13 and 13' are made of a material that cannot be plated. This is to securely prevent penetration of static electricity. In addition, this causes only the push portions 11 and 11' to be covered with the plating layers 12 and 12' in the plating process for the buttons 10 and 10'.

In this embodiment, two buttons 10 and 10' are connected using the connection portion 15 to form the button array 20. The connection portion 15 is composed of an elastic bridge 16 for giving an elastic force to the buttons 10 and 10', and a fixing frame 17 for fixing the button array 20 to the case 1. Here, the connection portion 15 is made of the same material as the switch contacts 13 and 13'. That is, the connection portion 15 is made of an insulating material, preferably a non-plating material.

In this embodiment, two elastic bridges 16 are provided in parallel between the buttons 10 and 10' to connect the switch contacts 13 and 13' to each other. The elastic bridge 16 is constructed to be elastically deformed in view of the shape and material properties thereof. Thus is to allow the buttons 10 and 10' to be restored to their original positions after a force that has been applied thereto is removed.

The fixing frame 17 is provided between the elastic bridges 16, and it may be formed integrally with the elastic bridges 16. In addition, a fixing hole 18 is formed through the center of the fixing frame 17. An element for fixing the button array 20 at a specific position on the electronic product is engaged with the fixing hole 18.

In this embodiment, a protrusion (not shown) formed on a back surface of the case 1 is inserted into the fixing hole 18 so that the button array 20 is fixed to the case 1. This is to prevent any play of the button array 20 in the inner space 2.

Figure 4:
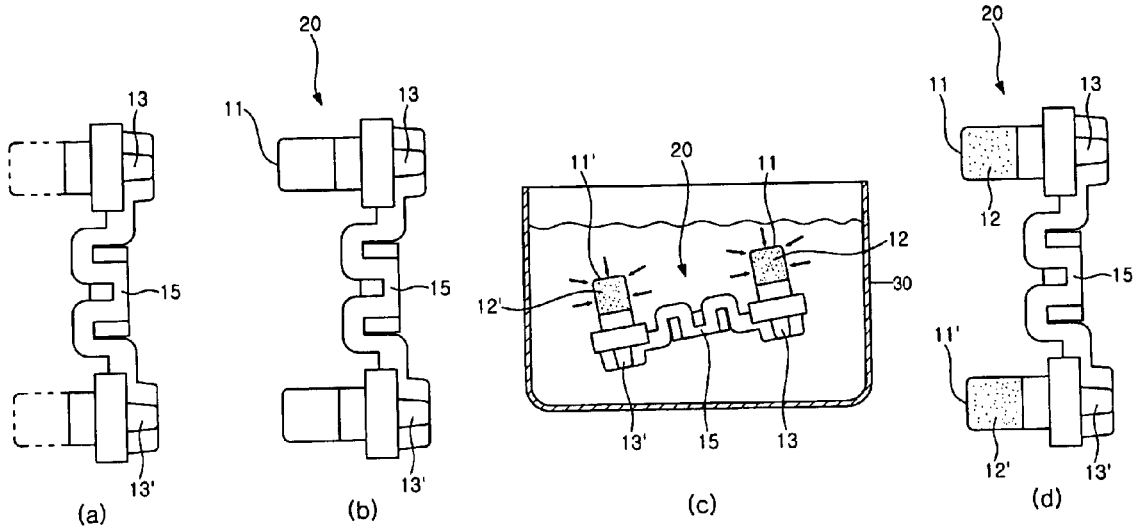
FIG. 4 illustrates a process of manufacturing the button array according to the embodiment of the present invention.

Next, a process of manufacturing the button array according to the embodiment of the present invention will be described. FIG. 4 illustrates a process of manufacturing the button array according to the embodiment of the present invention. In the present invention, the push portions 11 and 11' exposed outward are plated, whereas the switch contacts 13 and 13' connected to the internal system and the connection portion 15 are not plated.

To this end, the button array 20 is molded by means of dual injection molding. The dual injection molding refers to a molding method in which a primary molded body that has been molded out of a first resin is placed into a second cavity and the second cavity is filled with a second resin, thereby performing simultaneous molding.

Here, either the push portions 11 and 11', and the switch contacts 13 and 13' and the connection portion 15 may be the primary molded body. The following description will be made in connection with a case where the switch contacts 13 and 13' and the connection portion 15 are selected as the primary molded body.

First, the switch contacts 13 and 13' and the connection portion 15 are injection molded integrally to form a primary molded body as shown in FIG. 4(*a*). That is, a first resin is filled in a mold for forming the primary molded body, thereby injection molding the primary molded body. Here, the first resin is preferably an insulating material. In addition, the first resin is a non-plating material, i.e., a material that cannot be plated.

Then, a second resin is filled in a second cavity to integrate the primary molded body with the push portions 11 and 11', thereby injection molding the push portions 11 and 11' as shown in FIG. 4(*b*). Here, the second resin is a plating material, i.e., a material that can be plated.

When the button array 20 is integrally molded by means of the dual injection molding as described above, the plating layers 12 and 12' are formed on the push portions 11 and 11'. This is to improve the durability and design of the push portions 11 and 11' since the push portions 11 and 11' are exposed outward and subjected to frequent contacts.

In order to form the plating layers 12 and 12', the button array 20 integrally molded by means of the dual injection molding is put into a plating bath 30 as shown in FIG. 4(*c*). At this time, in view of the properties of materials, the switch contacts 13 and 13' and the connection portion 15 made of a non-plating material are not plated, whereas the plating layers 12 and 12' are formed only on the surfaces of the push portions 11 and 11' made of a plating material. Thus, there is no need for an additional masking operation for preventing the switch contacts 13 and 13' and the connection portion 15 from being plated. When the plating process is completed as described above, the button array is completely manufactured.

Hereinafter, the operation of the button array according to the embodiment of the present invention constructed as above will be described with reference to FIG. 1.

First, the operation of a button will be explained as follows. If a user pushes the button 10, a force is applied to the push portion 11 of the button, which is exposed out of the case 1. In addition, the external force is transferred to the switch contact 13 integrally formed with the push portion 11. At this time, the position of the switch contact 13 is changed due to elastic deformation of the elastic bridge 16. Then, the switch contact 13 pushes the switch 4, so that a signal is applied to the internal system that in turn is operated in response to the applied signal.

If the user releases the button 10, the force applied to the push portion 11 is removed, and the elastic bridge 16 is restored to its original position due to its restoring force. Thus, the switch contact 13 is separated from the switch 4 and at the same time returns to its initial position.

Now, the process of preventing introduction of static electricity by means of the button array 20 of the present invention will be described. In the button array 20, the push portions 11 and 11' having the plating layers 12 and 12' formed thereon are conductive, whereas the switch contacts 13 and 13' and the connection portion 15 without a plating layer thereon are non-conductive.

First, the surface of the push portion 11 is charged with static electricity due to the contact of the user. Since the push portion 11 is made of a plating material, the static electricity flows into the push portion 11. If the static electricity reaches the switch contact 13 through the push portion 11, the static electricity does not flow any longer since the switch contact 13 is made of an insulating material.

As mentioned above, the static electricity charged to the push portion 11 is shielded by means of the switch contact 13 made of an insulating material. Thus, the static electricity is prevented from penetrating to the switch 4 provided on the board.

Hereinafter, another embodiment of the present invention will be described.

Figure 5:
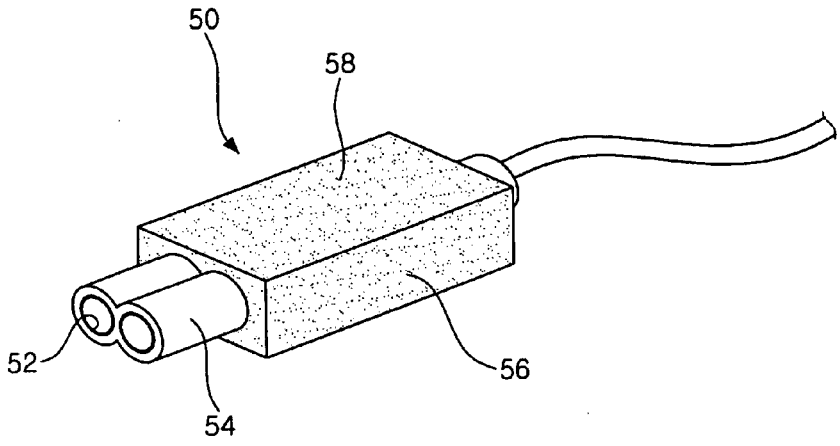
FIG. 5 is a perspective view showing a connector according to another embodiment of the present invention.

FIG. 5 is a perspective view showing a connector according to another embodiment of the present invention. As shown in FIG. 5, the connector 50 has a terminal 52, which is electrically connected to an internal system of an electronic product or directly brought into contact therewith. A housing 54 is provided as a system-contacting portion surrounding an outer circumference of the terminal 52. That is, the housing 54 is inserted into the electronic product and ensures protection of the terminal 52 and accurate electrical connection of the terminal 52. A grip 56 is provided at a rear end of the housing 54. The grip 56 is a portion with which a hand of a user comes into contact when the user intends to connect or disconnect the terminal 52 to/from the internal system of the electronic product.

In this embodiment, since the housing 54 is brought into contact with the internal system of the electronic product together with the terminal 52, the housing 54 is preferably made of an insulating material. In addition, the housing 54 is made of a non-plating material, i.e., a material that cannot be plated, so that the housing 54 is not plated. Meanwhile, any portion exposed out of the electronic product or directly brought into contact with the system, such as the grip 56, is made of a plating material that can be plated.

In the connector 50 constructed as above, the housing 54 and the grip 56 are integrally formed by means of dual injection molding out of different kinds of materials. More specifically, the housing 54 is first injection molded out of a material that can be plated, and the grip 56 is then injection molded out of a material that cannot be plated. In this case, the connector 50 is constructed in such a manner that the housing 54 and the grip 56 made of different materials are molded integrally with each other.

In addition, in order to prevent static electricity from flowing into the internal system through the grip 56, the integrally molded connector 50 is put into a plating bath so as to form a plating layer 58 only on the grip 56 made of a plating material.

That is, in the connector in which a portion to be brought into contact with an external system is conductive and a portion to be brought into connect with an internal system is non-conductive, a boundary is clearly established between the conductive portion and the non-conductive portion. Thus, even though the grip 56 having the plating layer 58 formed thereon is charged with static electricity due to contact of a user, the static electricity does not flow into the internal system due to the non-conductive housing 54. In addition, since the plating layer 58 is formed on the grip 56, the grip shields electromagnetic waves and protects a circuit against a current flowing from the outside.

The scope of the present invention is not limited to the aforementioned embodiments but defined by the appended claims. It will be apparent to those skilled in the art that various changes and modifications can be made within the scope of the invention defined by the claims.

That is, although the embodiments of the present invention have been described in connection with the button array and the connector, it will be obvious that the present invention can be applied to any component of which one end is brought into contact with a system and the other end is exposed outward.

As specifically described above, the antistatic component and the method of manufacturing the same according to the present invention have the following advantages.

According to the present invention, a push portion and a grip of a part, which are exposed outward, are plated but a switch contact and a housing to be brought into direct contact with an internal system are made of an insulating material. Therefore, in the present invention, any static electricity flowing through the push portion and the grip is shielded by means of the switch contact and the housing, thereby preventing further introduction of the static electricity. Thus, the present invention can effectively protect the internal system against static electricity or a current flowing from the outside while sufficiently ensuring good appearance of a button.

In addition, the present invention employs a dual injection molding method for molding two kinds of materials at once. In addition, only the push portion of the button and the grip of the connector are made of a plating material, and the switch contact and the housing are made of a non-plating material. Therefore, according to the preset invention, it is possible to plate only the push portion of the button without providing any additional plating-prevention treatment to the switch contact in the process of plating the button array and the connector. Thus, the present invention advantageously reduces production costs and improves productivity.

What is claimed is:

1. A button array, comprising:

buttons, each of which includes a push portion formed at a first end of the respective button and made of a first resin, the push portion being exposed outward and arranged to be pushed, the push button having a plating layer formed thereon, and a switch contact formed at a second end of the respective button and made of a second resin, the switch contact configured to selectively operate a switch; and an elastically-deformable connection portion formed integrally with the switch contact so as to connect the plurality of buttons to one another, wherein the switch contact, the connection portion, and the push portion are molded by means of dual injection molding, wherein the connection portion includes:

at least two elastic bridges provided in parallel between the buttons and arranged to connect the switch contacts to each other, the at least two elastic bridges constructed to be elastically deformed so as to give an elastic force to the buttons, and a fixing frame provided between the at least two elastic bridges and formed with a fixing hole into which a fixing device is inserted to couple the fixing frame with an electronic product, wherein the fixing hole is formed through the center of the fixing frame, and wherein the connection portion is made of the same material as the switch contact.

* * * * *